United States Patent [19]

Anderson

[11] 3,937,363

[45] Feb. 10, 1976

[54] COLLAPSIBLE LIQUID CONTAINER FOR USE WITH PLASTIC LINERS

[76] Inventor: Alfred F. Anderson, 73 Grier Road, Vernon, Conn. 06066

[22] Filed: Oct. 16, 1974

[21] Appl. No.: 515,257

Related U.S. Application Data

[63] Continuation-in-part of Ser. No. 412,905, Nov. 5, 1973, abandoned.

[52] U.S. Cl. ..... 222/105; 220/6

[51] Int. Cl.[2] ..... B65D 35/56; B67D 3/00

[58] Field of Search ..... 222/105, 94, 95, 130, 173, 222/183; 220/6

[56] References Cited

UNITED STATES PATENTS

| | | | |
|---|---|---|---|
| 2,321,836 | 6/1943 | Marzo | 222/105 X |
| 3,138,293 | 6/1964 | Roak et al. | 222/105 |
| 3,360,180 | 12/1967 | Venturi | 220/6 X |
| 3,448,897 | 6/1969 | Sterling | 222/105 |
| 3,752,349 | 8/1973 | Rana | 220/6 |

*Primary Examiner*—Stanley H. Tollberg
*Assistant Examiner*—Joseph J. Rolla

[57] ABSTRACT

A container of the type operable for housing therewithin another container is provided having a first pair of opposed side walls, a second pair of opposed side walls, and a pair of opposed end walls. The side edges of the first and second pairs of opposed side walls are interconnected along substantially the entire length thereof whereby to form a housing unit. At least one pair of the first and second pairs of side walls embody means operable for purposes of enabling the pair of side walls so equipped to move between a uncollapsed and a collapsed position. The pair of opposed end walls are mounted on the other pair of the first and second pairs of opposed side walls for movement between an open and a closed position relative thereto. Cooperating means are provided on the pair of opposed end walls and the aforesaid other pair of the first and second pairs of opposed side walls operable for purposes of securing the pair of opposed end walls in the closed position. The container is movable between a first condition corresponding to the collapsed condition thereof wherein the one pair of the first and second pairs of opposed side walls are in their collapsed position and a second condition corresponding to the uncollapsed condition thereof wherein the aforereferenced one pair of the first and second pairs of opposed side walls are in their uncollapsed position. There is formed in one of the walls of the container an opening which is operable for purposes of detachably mounting therein a spigot. The latter spigot in turn functions as the means by which fluid material present in the interior of the container is capable of being dispensed therefrom. In addition, a second opening is formed in one of the walls of the container with which a funnel means is cooperable for purposes of causing material to flow into the interior of the container.

8 Claims, 11 Drawing Figures

COLLAPSIBLE LIQUID CONTAINER FOR USE WITH PLASTIC LINERS

This application is a continuation-in-part of Ser. No. 412,905 filed Nov. 5, 1973, now abandoned.

BACKGROUND OF THE INVENTION

Throughout the years, millions and millions of containers of all types have been made and employed. Many of the containers have been designed for a particular use while others are intended to have general utility. Moreover, there are containers which have been designed to be used only a single time whereas there are others that are employed over and over again countless numbers of times. Insofar as concerns size and weight, containers have been provided heretofore which are very minute in size and weigh a few ounces at most, while there are some other containers which have been built that encompass tens of square feet and weigh hundreds of pounds.

Containers have also been provided heretofore whose primary function is to serve as an enclosure for another container. In such instances, the outer container is generally employed either as a means of permitting a multiplicity of smaller containers to be grouped as a unit or as a means of providing a protective cover for the smaller container. In the latter case, the outer container commonly is constructed so as to be self-supporting, and is made from a relatively rigid and durable material capable of providing the container with a relatively long life. Another feature which such containers must possess is that they must embody means operable for purposes of providing access to the interior thereof so as to permit the smaller container to be placed therein.

Notwithstanding the fact that containers possessing the latter features have been provided previously, a need is nevertheless been evidenced for a container which is capable of serving as an enclosure for another container and which is capable of being collapsed when not in use. For example, it is often desirable to employ such containers for storage purposes. More particularly, a need often exists to provide something in which to store liquids for relatively short periods of time, or when liquids are provided in plastic containers to provide an enclosure for the latter until such time as all of the liquid has been dispensed therefrom. One set of conditions under which this need is often encountered is on camping trips. In such instances water and other forms of potable liquids are commonly provided at the camp sites. However, the campers must provide their own containers therefor. One common expedient employed for this purpose is a plastic liner. The latter does not occupy much space when not filled, and thus can easily be packed along with other camping equipment as a part thereof. At the camp site, the linear can be readily filled. However, inasmuch as the liner in many instances is not self-supporting when filled, it is rather difficult to dispense liquid therefrom. Moreover, the liner is susceptible to being punctured if engaged by a pointed object. Therefore, it can readily be seen that it would be desirable to provide some means in which the liner could be housed, and which would be operable to function as a protective cover for the liner as well as providing means capable of facilitating the dispensing of liquid from the liner. On the other hand, such a means must also possess the capability of being collapsed so as to present a configuration which will occupy a minimal amount of space.

Another use which is capable of being made of such a container is as a receptacle for waste products particularly where the latter takes the form of sewage. For instance during camping trips, there is always a certain amount of sewage produced. If the camping takes place at one of the more developed camp sites, the latter are commonly provided with suitable hookups for water, waste disposal, electricity, etc. designed to be used with camping trailers and other similar forms of vehicles. However, where such hookups are unavailable, the waste products which are produced are commonly collected in a suitable temporary storage receptacle and thereafter are disposed of in the particular area which has been designated for use for this purpose at the camp site, or at another suitable location which has been set aside for this purpose in relatively close proximity to the camp site. The aforereferenced container equipped with a liner is suitably constructed so as to be employable for this purpose. More specifically, at periodic intervals the sewage which is produced while camping at a given camp site may be dispensed into the liner which in turn is suitably housed within the container. When the liner becomes filled, or upon leaving the camp site which ever occurs first, the contents are removed from the liner and disposed of at an area designated therefor and if so desired the liner may then also be removed from the container. If a need no longer exists for the container such as for instance upon departing from the camp site, the container is capable of being collapsed and stored away with the other items of camping equipment during the travel from one camp site to another, or from the camp site to home as the case may be.

Accordingly, it is an object of the present invention to provide a novel and improved container of the type operable for use in housing another container therewithin.

It is also an object of the present invention to provice such a container which is collapsible.

A further object of the present invention is to provide such a container which embodies means operable for purposes of dispensing therefrom material contained therewithin.

Still another object of the present invention is to provide such a container having at least one pair of side walls which are capable of being collapsed and a pair of end walls which are movable between an open and a closed position relative to the side walls of the container.

Yet another object of the present invention is to provide such a container which is capable of being equipped with funnel means operable for causing material to flow into the interior of the container.

Yet still another object of the present invention is to provide such a container which is relatively inexpensive to manufacture, is easy to employ, yet is sufficiently durable so as to be capable of withstanding the rigors of normal wear and tear thereby to provide a relatively long operating life.

SUMMARY OF THE INVENTION

It has now been found that the foregoing and related objects can be readily attained in a container of the type operable for housing another container therewithin. The container is provided with a plurality of side walls which are interconnected along substantially the entire length of the side edges thereof whereby to form a tubular unit, and a pair of opposed end walls. At least one pair of side walls embody means operable for purposes of enabling the pair of side walls so equipped to move between an uncollapsed and a collapsed position. The pair of opposed end walls are mounted on another pair of side walls for movement between an open and a closed position relative thereto. Cooperating means are provided on the pair of opposed end walls and on the aforereferenced another pair of side walls operable for purposes of securing the pair of opposed end walls in the closed position. The container is movable between a first condition corresponding to the collapsed condition thereof wherein the first referenced pair of side walls are in their collapsed position and a second condition corresponding to the uncollapsed condition thereof wherein the first referenced pair of side walls are in their uncollapsed position. There is formed in one of the walls of the container an opening which is operable for purposes of detachably mounting therein a spigot. The latter spigot in turn functions as the means by which fluid material present in the interior of the container is capable of being dispensed therefrom. In addition, a second opening is formed in one of the walls of the container with which a funnel means is cooperable for purposes of causing material to flow into the interior of the container.

In accordance with the preferred embodiment of the invention, all of the side walls as well as the pair of opposed end walls of the container are formed of metal. Moreover, the pair of side walls which are designed to be collapsed are of two-part construction. The means embodied therein whereby the side walls are capable of being collapsed comprise a plurality of hinges mounted in suitably spaced relation along adjacent side edges of the two portions which comprise each of these collapsible side walls. Preferably, the pair of opposed end walls are mounted on two of the side walls through the use of a plurality of hinges, the latter having one leaf thereof connected to the end wall and the other leaf connected to one of the side walls. The pair of opposed end walls are secured in the closed position by means of a plurality of snap clamps. In accord with the preferred embodiment of the invention, a pair of such snap clamps are employed with each end wall. In addition, the container is provided with an outwardly extending, upstanding lip surrounding the second opening. The funnel means comprises a spiral spring of varying diameter which is mountable on the container with the small diameter end of the spiral spring seated against the container so that the upstanding lip surrounding the second opening is received within the small diameter end of the spiral spring and with the open end of the liner being passed through the center of the spiral spring and thereafter detachably secured to the latter.

In accord with another aspect of the present invention, a container is provided having a first pair of opposed side walls formed of metal, a second pair of opposed side walls of non-metallic construction, and a pair of opposed end walls which are of metal construction. The first pair of side walls are each provided along at least one pair of side edges thereof with a substantially U-shaped channel-like portion. For purposes of interconnecting the second pair of side walls to the first pair of side walls to form a housing unit, the corresponding side edges of the second pair of side walls are inserted into the aforedescribed channel portions.

Thereafter, the sides of each of the latter portions are pinched together to capture the side edges of the second pair of side walls therewithin. The pair of opposed end walls are attached to the first pair of opposed side walls preferably by being hinged thereto. In addition, at least one of the first pair of side walls is provided with an opening in which a spigot may be mounted. The material from which the second pair of opposed side walls are formed preferably is selected from a suitable plastic or fabric material which is sufficiently resilient so as to be collapsible upon itself. Since the second pair of side walls are capable of being collapsed, the container itself may be collapsed merely by moving the pair of end walls to the open position thereof and causing the second pair of side walls to collapse upon themselves.

In accordance with another aspect of the invention, a container is provided of metal construction. At least two of the plurality of side walls thereof are of two-part construction. The two portions which comprise each of the latter two side walls are interconnected by means of a longitudinally extending length of tape which is substantially equal in length to the adjacent side edges of the two portions and which is affixed thereto.

DETAILED DESCRIPTION OF THE ILLUSTRATED EMBODIMENTS

Figure 1:
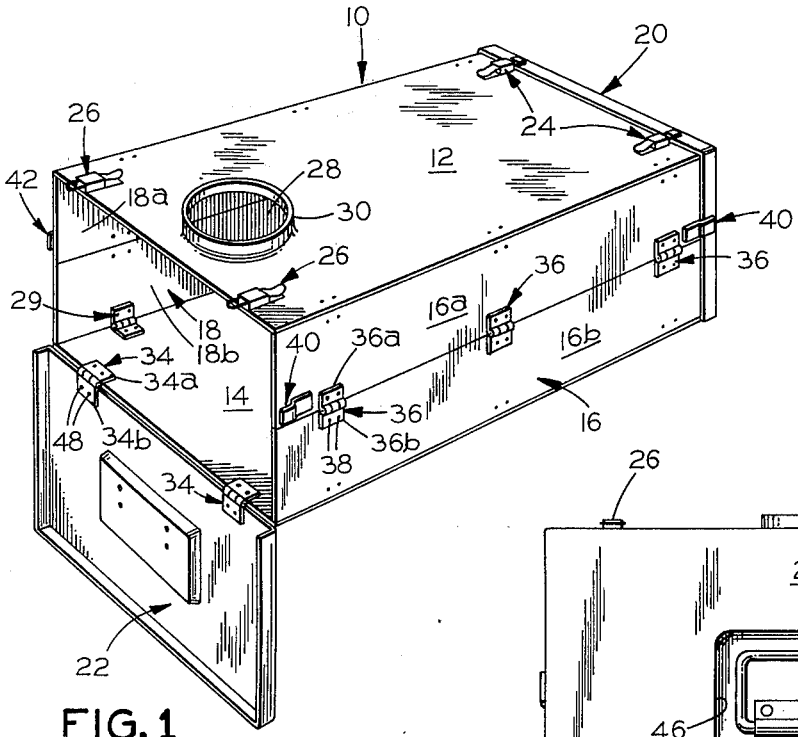
FIG. 1 is a perspective view of a container constructed in accordance with the present invention.
Figure 2:
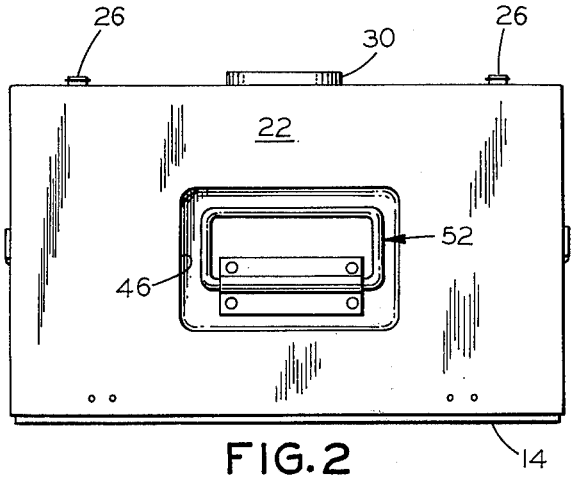
FIG. 2 is an end view of a container constructed in accordance with the present invention.

Referring now to the drawings, and more particularly FIG. 1 thereof, there is illustrated therein a container, generally designated by reference numeral 10, constructed in accordance with the present invention. As depicted therein, the container 10 has a substantially rectangular configuration. The latter configuration is provided by a first pair of opposed side portions 12 and 14, a second pair of opposed side walls 16 and 18, and a pair of opposed end walls 20 and 22. In accord with the illustrated embodiment of the invention depicted in FIGS. 1-5 of the drawings, all of the side walls, i.e., side walls 12, 14, 16 and 18 as well as the pair of end walls 20 and 22 are of metal construction.

Turning now to a more detailed description of the construction of the side walls 12, 14, 16 and 18 and the end walls 20 and 22, each of these walls is preferably made from sheet metal. Insofar as concerns specifically the side wall 12, the latter is generally rectangular in shape. Along the long sides thereof, the side edges of side wall 12 are interconnected to one of the side edges of the opposed side walls 16 and 18, respectively. More specifically, this interconnection of side wall 12 to side walls 16 and 18 is preferably accomplished through the use of a plurality of hinges 23 and 25, only one of each of which is visible along each of the long sides of the side wall 12 in FIG. 3 of the drawings. Each of the hinges 23 has a leaf **23*a* affixed to the inner surface of the side wall 12 and a leaf 23*b* secured to the inner surface of side wall 16. In similar fashion, the leaf 25*a* of the hinge 25 is fastened to the inner surface of side wall 12 and the other leaf 25*b* thereof is affixed to the inner surface of side wall 18. The hinges 23 and 25 have been omitted from FIGS. 1 and 5 of the drawings in the interest of maintaining therein clarity of illustration. Spaced inwardly of the edges of the short sides of the side wall 12, there are provided pairs of snap clamp means 24 and 26, respectively. Each of the snap clamp means 24 and 26 comprises a catch portion, not visible per se in the drawing, which is carried by the side wall 12 and a hook portion, also not visible per se in the drawings, which is cooperable with the aforedescribed catch portion and which is carried by the end walls 20 and 22. The snap clamp means 24 are operable for purposes of securing the end wall 20 in a closed position relative to the side wall 12. Similarly, the snap clamp means 26 are operable to secure the end wall 22 in a closed position relative to the side wall 12. The snap clamp means 24 and 26 may take the form of any of the various types of snap fasteners which are commercially available, without departing from the essence of the invention. In addition, the side wall 12 is provided with an opening 28 formed therein so as to be positioned inwardly of the edge thereof adjacent to which the snap clamp means 24 are mounted. The opening 28, to which further reference will be had hereinafter, in accord with the illustrated embodiment of the invention is preferably provided with an outwardly projecting upstanding rim, i.e., lip 30**.

The construction of the side wall 14 is similar to that of the side wall 12 in that the former is also rectangular in configuration. Moreover, the side edges of side wall 14 are also interconnected to one of the side edges of the opposed side walls 16 and 18, respectively. Here too, the interconnection of the side edges of the side wall 14 with the side edges of the side walls 16 and 18 is preferably accomplished through the use of a plurality of hinges 27 and 29, only one of each of which is visible along each of the long sides of the side wall 14 in FIG. 3 of the drawings. Each of the hinges 27 has a leaf **27*a* affixed to the inner surface 14 and a leaf 27*b* secured to the inner surface of side wall 16. In similar fashion, the leaf 29*a* of the hinge 29 is fastened to the inner surface of side wall 14 and the other leaf 29*b* thereof is affixed to the inner surface of side wall 18. The hinges 27 and 29 have been omitted from FIGS. 1 and 5 of the drawings in the interest of maintaining therein clarity of illustration. Adjacent the side edge of each of the short sides thereof, the side wall 14 has fastened thereon a leaf of one of the pair of hinges 32 and 34, respectively. More specifically, leaf 32*a* of each of the pair of hinges 32 is affixed in spaced relation along the side edge of one of the short sides of the side wall 14 and the leaf 34*a* of each of the pair of hinges 34 is fastened to the side wall 14 in spaced relation along the side edge of the other short side thereof. The hinges 32 and 34 in a manner yet to be described function as a means of pivotably connecting the end walls 20 and 22 to the side wall 14**.

Figure 3:
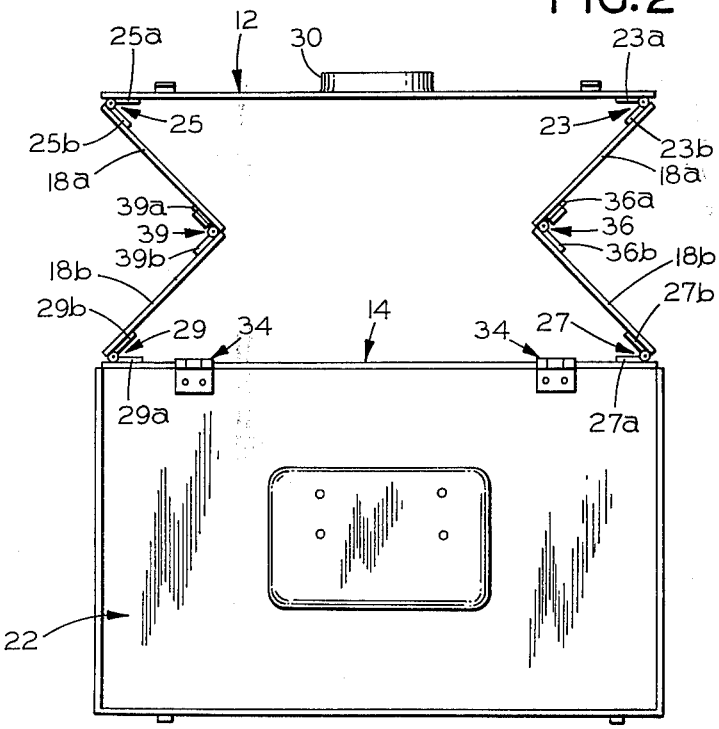
FIG. 3 is an end view of a container constructed in accordance with the present invention, illustrating the container in a partially collapsed condition and with the end walls open.

Turning next to a description of the construction of the side walls 16 and 18, the latter in accord with the embodiment of the invention illustrated in FIGS. 1–5 of the drawings are each of two-part construction. More particularly, side wall 16 comprises two rectangularly shaped metal panels **16*a* and 16*b* which are interconnected by means of a plurality of hinges 36. In accord with the illustrated form thereof, three such hinges 36 are employed located along the length of the side wall 16 in spaced relation relative to each other. However, it is to be understood that a greater or a lesser number of hinges 36 could be employed for purposes of interconnecting panels 16*a* and 16*b* without departing from the essence of the invention. Each of the hinges 36 has one leaf 36*a* thereof fastened to the panel 16*a* and one leaf 36*b* thereof affixed to the panel 16*b*. The leaf 36*a* and the leaf 36*b* of each hinge 36 are preferably secured to the panels 16*a* and 16*b*, respectively, through the use of threaded fasteners 38. As depicted in FIGS. 1–5 of the drawings, the hinges 36 are positioned on the exterior of the panels 16*a* and 16*b* whereby the latter panels are capable of collapsing, i.e., pivoting inwardly as depicted in FIG. 3 of the drawings. The latter pivoting movement of the panels 16*a* and 16*b* is further permitted by virtue of the hinge connections which exist between the side wall 16 and the side walls 12 and 14, the latter being provided through the operation of the hinges 23 and 27. The side wall 16 is also provided at each end thereof with a support member 40. The latter members 40 as best seen with reference to FIG. 4 of the drawings are of generally planar construction but with a portion 40*a* thereof being offset so that when the members 40 are mounted on the side wall 16, the portions 40*a* thereof are spaced from the plane of the side wall 16 a suitable distance thereby to enable the overhang edges of the end walls 20 and 22 to be received between the portions 40*a* and the outer surface of the side wall 16. Any conventional form of fastening means such as welding, threaded fasteners, rivets, etc. may be utilized for purposes of mounting the members 40 on the side wall 16. In this regard, it is, of course, to be noted that since the panels 16*a* and 16*b* which comprise the side wall 16 are intended to possess the capability of pivoting relative to each other, the members 40 must be mounted in such a manner as not to inhibit this pivoting action of the panels 16***a* and 16*b*. In the interest of maintaining clarity of illustration therein, the members 40 have been omitted from FIGS. 2 and 3 of the drawings.

With regard to the construction of side wall 18, the latter has a construction which is substantially identical to that of side wall 16. More specifically, with particular attention directed to FIG. 3 of the drawings, side wall 18 is composed of a pair of rectangularly shaped panels 18*a* and 18*b*. Each of the latter panels has dimensions which conform substantially to those of the corresponding panels 16*a* and 16*b* of side wall 16. The panels 18*a* and 18*b* are interconnected at a plurality of locations along the major axis thereof by means of a multiplicity of hinges 39, only one of which is visible in the drawings. Each of the hinges 39 has one leaf 39*a* attached by means of threaded fasteners (not shown) to the panel 18*a* and the other leaf 39*b* fastened through the use of threaded fasteners (not shown) to the panel 18*b*. It is, of course, to be understood that the panels 18*a* and 18*b* are each provided with openings (not shown) suitably dimensioned to receive the aforementioned threaded fasteners therein. As has been previously described hereinabove, each of the long sides of side wall 18 in addition is interconnected to the side walls 12 and 14 by means of hinges 25 and 29, respectively. As shown in FIG. 3 of the drawings, the hinges 39 are positioned on the exterior of the panels 18*a* and 18*b* whereby the latter panels are capable of collapsing, i.e., pivoting inwardly as illustrated in FIG. 3 of the drawings. The latter pivoting movement of the panels 18*a* and 18*b* is further facilitated by the hinge connections which exist between the side wall 18 and the side walls 12 and 14. The latter mentioned hinge connections are provided by the hinges 25 and 29. In a manner similar to that set forth hereinabove in connection with the description of the side wall 16, the side wall 18 is also provided at each of the opposite ends thereof with a support member 42. The latter members 42 are substantially identical in construction to the members 40. More specifically, each of the members 42 as seen with reference to FIG. 4 of the drawings is provided with an offset portion 42*a*. The latter offset portion 42*a* is operable when the members 42 are affixed to the side wall 18 to provide a space between the latter and the offset portion 42*a* into which the overhanging edges of the end walls 20 and 22 are capable of being received when the latter end walls 20 and 22 are in their closed position, i.e., the position thereof best seen in FIGS. 4 and 5 of the drawings. The members 42 may be secured on the side wall 18 through the use of any conventional type of fastening means such as threaded fasteners, rivets, by welding, etc. Like the members 40, however, the members 42 must be mounted on the side wall 18 so as not to interfere with the pivoting action which the panels 18*a* and 18*b* which comprise the side wall 18 undergo in moving between their uncollapsed and their collapsed positions.

Figure 5:
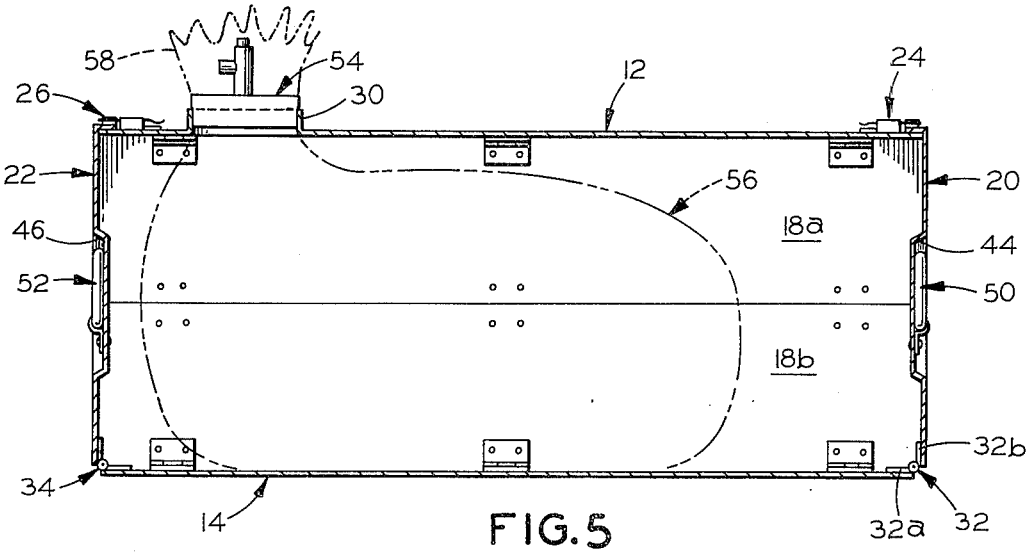
FIG. 5 is a cross-sectional view of a container constructed in accordance with the present invention.
Figure 4:
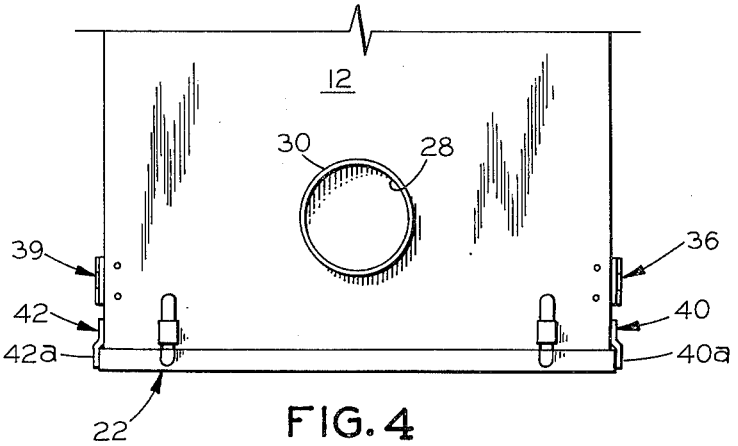
FIG. 4 is a top view of a portion of a container constructed in accordance with the present invention, illustrating the internal construction thereof and a plastic liner positioned therewithin.

Considering next the construction of the end walls 20 and 22, the latter are each substantially rectangular in shape. More specifically, each of the end walls 20 and 22 is generally planar in configuration except for the presence therein of a generally rectangular inwardly projecting recess 44 and 46, respectively, located approximately centrally therein. The latter recesses 44 and 46 are provided for a purpose which will be described subsequently. In addition, each of the end walls 20 and 22 is provided along three sides thereof with an overhanding edge. In this connection, the end walls 20 and 22 are suitably dimensioned so as to be slightly larger in area than the area defined by the side walls 12 and 14 and the side walls 16 and 18 when the latter are in the uncollapsed condition whereby when the end walls 20 and 22 are moved to their closed position relative to the side walls 12, 14, 16 and 18, the aforedescribed overhanging edges of the end walls 20 and 22 are positioned externally of and in juxtaposed relation to the outer surface of the side walls 12, 14, 16 and 18. Moreover, in the manner previously set forth hereinabove, the overhanging edges of the end walls 20 and 22, when the latter occupy their closed position, are captured between the support members 40 and 42 and the side walls 16 and 18, respectively. With particular reference to FIGS. 1, 4 and 5 of the drawings, it can be seen therefrom that the aforereferenced overhanging edges of the end walls 20 and 22 function in essence as a rim about the ends of the container 10 when the end walls 20 and 22 are in their closed position.

The end wall 20 has fastened thereto, adjacent the edge thereof which is not provided with an overhanging edge, the leaf 32*b* of each of the hinges 32. As a result of this hinge connection therebetween, the end wall 20 is capable of being made to move between an open position and a closed position relative to the ends of the side walls 12, 14, 16 and 18 when the latter two sides, i.e., side walls 16 and 18 are in their uncollapsed conditions. The leaf 32*b* of each of the hinges 32 may be fastened to end wall 20 through the use of any suitable type of conventional threaded fastener (not shown). In like fashion, the leaf 34*b* of each of the hinges 34 is fastened to the end wall 22 adjacent to the edge thereof which is not provided with an overhanging edge. This hinged interconnection between the end wall 22 and the side wall 14 enables the former to be moved between an open and a closed position relative to the side walls 12, 14, 16 and 18 when the latter two sides are in their uncollapsed condition. Any conventional form of fastening means such as, for example, threaded fasteners 48 may be employed for securing the leaf 34*b* of the hinges 34 to the end wall 22.

With reference again to the recesses 44 and 46, the latter each have mounted therein, in accord with the embodiment of the invention illustrated in FIGS. 1–5 of the drawings, a handle 50 and 52, respectively. The handles 50 and 52 are suitably mounted within the recesses 44 and 46, respectively, through the use of any conventional mounting means commonly employed for this purpose so that the handles 50 and 52 are positioned substantially flush with the external surface of the end walls 20 and 22, respectively. The handles 50 and 52 are thus readily accessible for use in grasping the container 10.

Completing the description of the container 10, the latter in accord with the embodiment thereof depicted in the drawings, is preferably provided with a spigot which by way of illustration may take the form of the embodiment of the spigot designated in FIG. 5 by reference numeral 54. The latter is suitably dimensioned so as to be capable of being positioned within the opening 28 with a frictional fit. In addition, the spigot 54 includes valving means (not shown) operable in a manner well-known to those skilled in the art to control the flow of fluid through the spigot 54. More specifically, the valving means (not shown) is capable of providing at least two operating conditions, i.e., one wherein fluid is dispensed therethrough and one wherein no fluid flow occurs therethrough.

A description of one method of employing the container 10 will now be set forth. Referring first to FIG. 3 of the drawings, when not in use the container 10 preferably is in a collapsed condition. To this end, each of the end walls 20 and 22 of container 10 is in its open position relative to the side walls 12, 14, 16 and 18, i.e., the position in which end wall 22 is shown in FIG. 3 of the drawings. Moreover, the side walls 16 and 18 are each collapsed inwardly in the manner depicted in FIG. 3 of the drawings, but to a greater extent than that depicted in the latter figure. When in the collapsed condition, the container 10 has an extremely compact configuration whereby it occupies minimal space and is easily transportable. With the container 10 in the aforedescribed collapsed condition, it is necessary before using the container 10 to cause the latter to be first erected. This is accomplished by causing the side walls 16 and 18 to pivot to the positions depicted in FIG. 1 of the drawings. Thereafter, one of the end walls, i.e., either end wall 20 or end wall 22 is moved to its closed position. In this regard, it is generally found desirable when the opening 28 is located nearest to the end wall 22 that the end wall 20 be the one that is moved to the closed position. The reason for this will become readily apparent from the description which follows hereinafter. Continuing with the description of this method of employing the container 10, after the end wall 20 has been moved to its closed position, the latter is preferably secured in this position through the use of the snap clamp means 24. The container 10 is then in a condition wherein another container such as the liner 56 depicted in dotted lines in FIG. 5 of the drawings may be inserted therewithin through the open end of the container 10, i.e., the end at which the end wall 22 is provided. The liner 56 which in accord with one contemplated use to which the container 10 may be put is preferably filled with some form of dispensible fluid. With the liner 56 inserted into the container 10 and with the end wall 22 still open, the end portion 58 of the liner 56 is inserted through the opening 28 from the interior to the exterior of the container 10. The latter action can readily be accomplished through the open end of the container 10 particularly wheen the open end thereof comprises the end at which the end wall 22 is located. On the other hand, if the open end of the container 10 were the end at which the end wall 20 is found, it should be readily apparent that the task of inserting the end 58 of the liner 56 would be somewhat more difficult inasmuch as it would be necessary to reach further into the container 10 to push the end 58 through the opening 28. It is, of course, to be understood that when the preceding steps are being taken, the container 10 is preferably positioned on a suitable surface so that it is supported whereby the opening 28 is located as shown in FIG. 1 of the drawings. Moreover, it is to be understood that the end 58 of the liner 56, the latter being filled with some form of liquid, is provided with a suitable seal (not shown). Once the end 58 has been passed through the opening 28, the latter mentioned seal is preferably broken. Then the spigot 54 is positioned within the opening 28 such that the end 58 of the liner 56 is captured between the side walls of the rim 30 of the opening 28 and the spigot 54. Thereafter, the edges of the end 58 of the liner 56 may, if so desired, be rolled back into engagement with the rim 30 of the opening 28 in the manner depicted in FIG. 5 of the drawings. Then, the end wall 22 is moved to its closed position relative to the side walls 12, 14, 16 and 18 and secured in the latter described position by means of the snap clamp means 26. Finally, the container 10 is turned on its end so that it is positioned as shown in FIG. 5 whereupon the fluid contained in the liner 56 is capable of being dispensed through the spigot 54 as desired.

When the liner 56 has been emptied, it may readily be removed from the interior of the container 10 by reversing the procedure set forth hereinabove. More specifically, the container 10 is once again turned on its side, i.e., to the position shown in FIG. 1 of the drawings. The spigot 54 is then removed from the opening 28. With the spigot 54 removed, the snap clamp means 26 are operated so that the end wall 22 is no longer secured in its closed position thereby. The end wall 22 thereafter is opened and the liner 56 is removed through the open end of the container 10. If it is desired to replace the empty liner 56 with a filled one, the latter is inserted through the open end of the container 10 and the procedure set forth above is once again followed. On the other hand, if the container 10 is no longer to be employed, it can be collapsed. As noted previously, the collapsing of the container 10 is accomplished by releasing the snap clamp means 24, moving the end wall 20 to its open position, and thereafter causing the side walls 16 and 18 to pivot inwardly.

Figure 6:
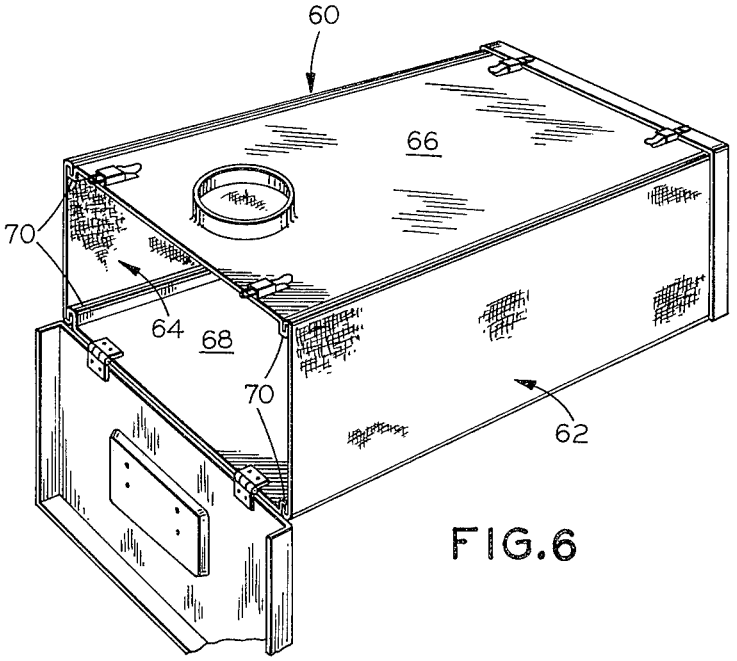
FIG. 6 is a perspective view of another embodiment of container constructed in accordance with the present invention.

Referring now to FIG. 6 of the drawings, there is shown therein another embodiment of container, generally designated by reference numeral 60, constructed in accordance with the present invention. With reference to FIG. 6, those elements of the container 60 which are substantially identical in construction to structure embodied in the container 10 which have been previously described hereinabove are identified in FIG. 6 by the same numerals employed to designate the same elements of container 10 in FIGS. 1–5 of the drawings. The container 60 differs from the container 10 primarily in the fact that container 60 is provided with a pair of side walls 62 and 64, each of which is of non-metallic construction. More specifically, the side walls 62 and 64 which correspond to the side walls 16 and 18, respectively, of the container 10 are made from a suitable plastic or fabric material having sufficient resiliency that the side walls 62 and 64 are capable of being collapsed, thereby enabling the container 60 to have both a collapsed and an uncollapsed condition. For purposes of interconnecting the side walls 62 and 64 to the other pair of side walls, i.e., side walls 66 and 68 of container 60, the latter side walls 66 and 68 are provided along each edge of the long sides thereof with a channel-like portion 70. The latter portions 70 extend substantially the entire length of the side walls 66 and 68. The interconnection of side walls 62 and 64 to side walls 66 and 68 is accomplished by inserting the side edges of the side walls 62 and 64 into the aforedescribed channel-like portions 70. The side walls of the latter portions 70 are then pinched together capturing the edges of the side walls 62 and 64 therebetween. This method of interconnecting the side walls 62 and 64 to the side walls 66 and 68 has been found to provide a sufficiently secure connection therebetween. Insofar as concerns the remainder of the elements embodied in the container 60, these elements are substantially identical in structure and function to the elements corresponding thereto which are embodied in the container 10. Since the structure and function of these elements has been set forth previously herein in connection with the description of the container 10, it is not deemed necessary to set forth herein a further description of these elements in connection with the description of the construction of the container 60.

Turning now to a description of the manner in which the container 60 is assembled and employed, the container 60 operates substantially in the same fashion as the container 10. Essentially the only difference therebetween is that instead of embodying a pair of side walls which are hinged together whereby to be capable of pivoting inwardly, i.e., into the interior of the container, the side walls 62 and 64 are made to collapse by virtue of their inherent resiliency. Otherwise, the container 60 operates in the same manner as container 10. Namely, with the container 60 in its collapsed condition, the container 60 is erected by causing the side walls 62 and 64 to occupy a substantially planar configuration, i.e., by straightening the side walls 62 and 64. Then the end wall 20 is pivoted to its closed position and secured in the latter position through the operation of the snap clamp means 24. Next the liner 56 is inserted into the interior of the container 60 and the end 58 thereof is passed through the opening 28 provided in the end wall 66. With the end 58 of the liner 56 having been unsealed the spigot 54 is mounted in the opening 28 thereby to capture the liner 56 between the rim 30 of the opening 28 and the spigot 54 and to provide a means for dispensing from the container 60 the fluid contained in the liner 56. Thereafter, the other end wall, i.e., end wall 22 is pivoted to its closed position and secured in place through operation of the snap clamp means 26. The container 60 can then be turned on its end so that the end wall 22 rests on a suitable supporting surface.

Figure 7:
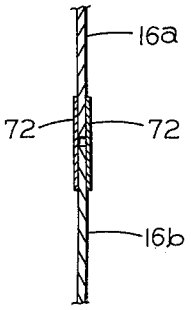
FIG. 7 is a cross-sectional view of a portion of a container constructed in accordance with the present invention, illustrating one side wall of the container embodying another form of means operable for interconnecting together the two portions which comprise the side wall.

With reference next to FIG. 7 of the drawings, there is depicted therein another type of means which may be employed for purposes of pivotably interconnecting together the two panels 16*a* and 16*b* which comprise the side wall 16 and the two panels 18*a* and 18*b* which comprise the side wall 18. To this end, rather than utilizing a plurality of hinges 36 and 38 for this purpose, the latter may be replaced by a tape 72 substantially equal in length to the length of the side walls 16 and 18. The tape 72 which may take the form of any of the types of tapes presently commercially available which are intended to be employed for joining two members together is suitably affixed to the adjacent edges of the long sides of the panels 16*a* and 16*b* and the panels 18*a* and 18*b*, respectively by being adhered thereto by the use of a suitable adhesive (not shown).

Figure 8:
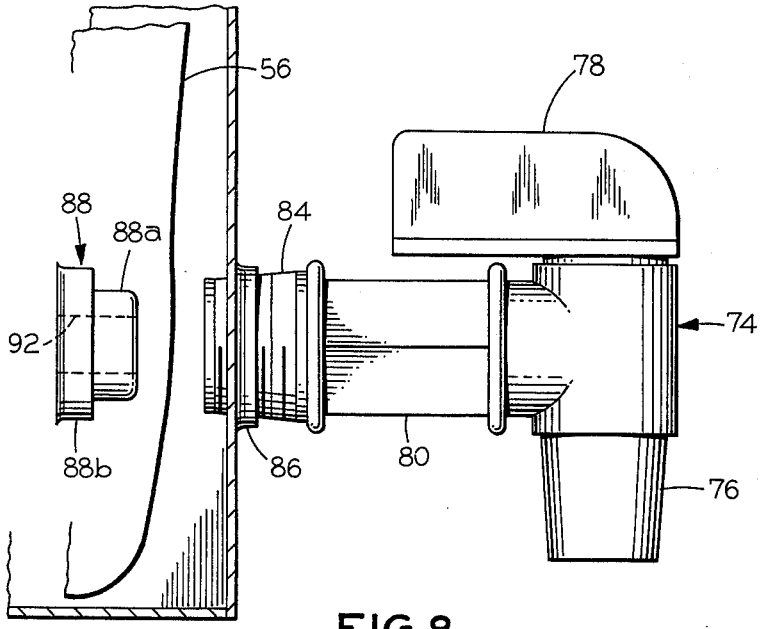
FIG. 8 is a side elevational view of a portion of a container constructed in accordance with the present invention, illustrating one embodiment of spigot employable therewith mounted in an opening provided therefor in one of the walls of the container.
Figure 9:
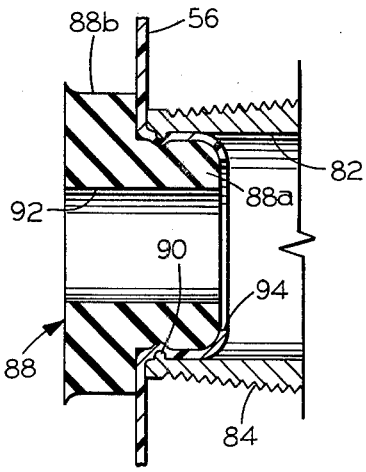
FIG. 9 is a cross-sectional view of a portion of the spigot of FIG. 8, illustrating the manner in which the plastic liner is secured thereto.

Turning now to FIGS. 8 and 9 of the drawings, there is illustrated therein another embodiment of spigot means, i.e., faucet, generally designated by reference numeral 74, which is capable of being employed with either container 10 or container 60 constructed in accordance with the present invention. The spigot means 74 differs from the spigot 54, which is found depicted in FIG. 1 of the drawings and which has been described previously hereinabove, both as to the manner in which it is mounted on either the container 10 or the container 60 as well as the method of employment thereof. More specifically, the spigot means 74 includes a spigot portion 76 which has a handle 78 preferably formed integrally therewith. The spigot portion 76 in a manner well-known to those skilled in the art is provided with a suitably configured hollow interior (not shown) and an opening (not shown) formed in the side wall thereof which provides communication with the aforesaid hollow interior of the spigot portion 76 so as to form a fluid passage therebetween. In addition, the spigot means 74 includes a tubular member 80 at one end of which the aforedescribed spigot portion 76 is suitably mounted so as to be rotatable relative thereto. The tubular member 80 which also has a suitably configured hollow interior 82 has a multiplicity of screw threads 84 formed on the external surface thereof adjacent the free end thereof. The latter multiplicity of screw threads 84 are employed for purposes of detachably mounting the spigot means 74 to the container 10 or the container 60. Assuming that the spigot means 74 is to be employed with the container 10, one of the walls thereof as best understood with reference to FIG. 8 of the drawings has an opening formed therein (not shown) which is surrounded by an upstanding rim 86. As applied to the container 10, the latter referenced opening may be provided in either one of the pair of end walls 20 or 22, or in either one of the pair of side walls 12 or 14, with the selection of which wall is to have provided therein the aforereferenced opening, being dependent upon how it is desired to locate the container 10 for purposes of dispensing therefrom the contents thereof. Namely, if it is desired to rest the container 10 on either of the pair of side walls 12 or 14 for dispensing purposes then the aforedescribed opening would be provided in one of the pair of end walls 20 or 22, and conversely if the container 10 is to rest on one of the pair of end walls 20 or 22 for dispensing purposes then the aforedescribed opening is provided in one of the pair of side walls 12 or 14.

There will now be described the manner in which the interconnection between the hollow interior 82 of the tubular member 80 of the spigot means 74 and the interior of a plastic liner 56 located within the container 10 is accomplished. For this purpose, reference will be had to FIGS. 8 and 9 of the drawings. As shown therein, there is provided a resilient bushing 88 preferably formed from a resilient material such as rubber. The bushing 88 has one end 88*a* thereof which is of relatively small diameter and one end 88*b* thereof which is of relatively large diameter. More specifically, the end 88*a* of the bushing 88 is suitably dimensioned and configured so as to be insertable into the hollow interior 82 of the tubular member 80 of the spigot means 74 in the manner depicted in FIG. 9 of the drawings. To ensure that the bushing 88 remains securely fastened in the free end of the tubular member 80 of the spigot means 74, there is preferably formed a rib 90 within the hollow interior 82 at a location spaced inwardly of the free end of the tubular member 80. By virtue of the inherent resiliency of the bushing 88, the latter when the end 88a thereof is inserted into the hollow interior 82 is caused to be compressed by the rib 90 thereby providing a tight frictional interengagement between the rib 90 and the external side wall of the end 88*a* of the bushing 88. In the manner shown in FIG. 9 of the drawings, the bushing 88 functions to capture a portion of the plastic liner 56 between the end 88*a* of the former and the free end of the tubular member 80. This is accomplished by inserting the bushing 88 into the interior of the plastic liner 56 and thereafter into engagement with the free end of the tubular member 80. It will be noted that the bushing 88 has a through passage 92 formed at the center thereof. With the bushing 88 assembled in the free end of the tubular member 80 in the manner depicted in FIG. 9 of the drawings so that the plastic liner 56 is interposed between the former and the latter, it is possible to make a hole 94 in the plastic liner 56 by pushing a pointed object into the through passage 92 in the bushing 88 and into engagement with the plastic liner 56. This establishes a fluid flow passage between the interior of the plastic liner 56 and the exterior of the container 10. This fluid flow passage is composed of the through passage 92 in the bushing 88, the hole 94 in the plastic liner 56, the hollow interior 82 of the tubular member 80 and, when the opening (not shown) formed in the spigot portion 76 is aligned with the hollow interior 82 through manipulation of the handle 78, then through the aforereferenced opening in the spigot portion 76 to the hollow interior (not shown) of the latter and therethrough to the open end of the spigot portion 76. Obviously, since for purposes of capturing the plastic liner 56 between the free end of the tubular member 80 of the spigot means 74 and the bushing 88 it is required that the latter be inserted into the former from the inside of the plastic liner 56, the spigot means 74 is limited in its employment to situations wherein the plastic liner 56 is filled with contents only after the plastic liner 56 has been placed within the container 10. For those applications wherein the plastic liner 56 is prefilled, i.e., is filled before being placed inside the container 10, it is preferable to employ a spigot embodying a construction such as that of the spigot 54 which was previously described hereinabove.

Assuming that the spigot means 74 is being employed, once the contents of the plastic liner 56 have been emptied therefrom the spigot means 74 may be dismounted from the container 10 whereby to enable the latter to be placed in its collapsed condition. This is accomplished simply by removing the bushing 88 from the free end of the tubular member 80 and thereafter unscrewing the spigot means 74 from the container 10. If so desired, the plastic liner 56 may also be removed from the interior of the container 10 prior to the latter being placed in its collapsed condition. In accord with the preferred manner of employment of the spigot means 74, once the latter has been dismounted from the container 10, the opening (not shown) formed in the side wall of the latter is closed by means of the bushing 88. More specifically, the end **88*b* of the bushing 88** is suitably configured and dimensioned so as to be receivable within the aforereferenced opening with a frictional fit.

Figure 10:
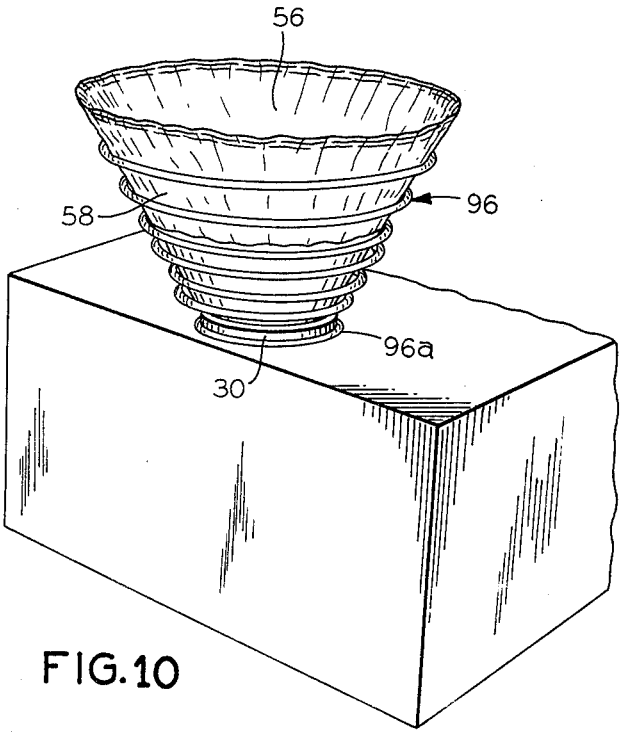
FIG. 10 is a perspective view of a funnel means employable with a container constructed in accordance with the present invention for purposes of causing material to flow into the plastic liner housed within the container.
Figure 11:
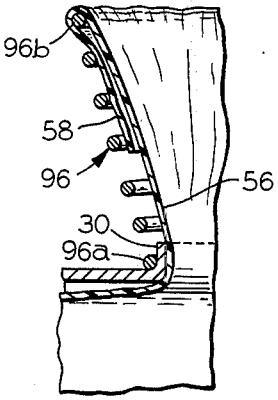
FIG. 11 is a cross-sectional view of a portion of the funnel means of FIG. 10, illustrating the manner in which the open end of the plastic liner is attached to the funnel means.

In the event that a need exists to fill the plastic liner 56 after the latter has been placed within the interior of either the container 10 or the container 60 constructed in accordance with the present invention, there will now be set forth with reference to FIGS. 10 and 11 of the drawings a description of a means and a method whereby this function is capable of being accomplished. The means to which reference is had in this instance consists of a funnel means which is cooperable with the opening 28 with which each of the containers 10 and 60 is provided as has been described previously hereinabove. More specifically, the aforesaid funnel means consists of a spiral spring of varying diameter, i.e., having one end **96*a* thereof which is of relatively small diameter and the other end 96*b* thereof which is of relatively large diameter. To employ the spiral spring 96 as shown in FIGS. 10 and 11 of the drawings, the small end 96*a* of the spiral spring 96 is seated on either the container 10 or the container 60 so that the upstanding rim, i.e., lip 30 surrounding the opening 28 is received within the small diameter 96*a*. To this end, the small end 96*a* is suitably dimensioned so as to embody a diameter which is slightly less then the diameter of the opening 28 which in order to position the small end 96*a* relative to the rim 30 in the manner depicted in FIGS. 10 and 11 of the drawings, the small end 96*a* of the spiral spring 96 must be biased outwardly to a slight extent whereby the small end 96*a* of the spiral spring 96 exerts an inward biasing force against the external side wall of the rim 30 which is effective to maintain the small end 96*a* of the spiral spring 96 in engagement with the rim 30. Once the spiral spring 96 has been positioned in the aforedescribed manner relative to the opening 28, the open end of the plastic liner 56 is pulled through the center of the spiral spring 96. Thereafter, the end 58 of the plastic liner 56 is folded over the large end 96*b* of the spiral spring 96. In accord with the preferred method of employment of the funnel means, i.e., the spiral spring 96, the final step which is performed is to insert the end 58 of the plastic liner 56 between adjacent coils of the spiral spring 96 whereby the end 58 of the plastic liner 56 is captured between the inner surface of the coils of the spiral spring 96 and the outer surface of the open end portion of the plastic liner 56. It is thus seen that the spiral spring 96 when employed in the aforedescribed manner functions effectively and efficiently as a funnel. Once the plastic liner 56 has been filled to the desired extent, the end 58 of the plastic liner is pulled out from between the coils of the spiral spring 96. The next step is to remove the spiral spring 96 from the container. Thereafter, the open end of the plastic liner 56 is sealed, and the sealed end preferably is pushed through the opening 28 into the interior of the container, be it the container 10 or the container 60. When the spiral spring 96 is not in use, it is preferably placed in a collapsed condition wherein the small end 96*a* thereof is located within the large end 96*b* so that the spiral spring 96 presents a substantially flat configuration thereby occupying minimal space. Moreover, when the spiral spring 96 is in the aforedescribed condition, and the container, be it either the container 10 or the container 60, is also in a collapsed condition, the spiral spring 96** is capable of being stored within the latter container without significantly increasing the thickness of the latter.

Although several embodiments of the containers constructed in accordance with the present invention have been shown in the drawings and described hereinabove, it is to be understood that modifications in the construction thereof may be made thereto by those skilled in the art without departing from the essence of the invention. In this connection, some of the modifications which can be made in the containers 10 and 60 have been alluded to hereinabove while others will become readily apparent to those skilled in the art when exposed to the present description and illustration of the containers 10 and 60. For example, means other than the snap clamp means 24 and 26 may be utilized without departing from the essence of the invention for securing the end walls 20 and 22 in their closed position. Also, the support members 40 and 42 rather than being in the form of separate members could comprise areas of the side panels 16 and 18 that have been lanced out of the plane thereof. Moreover, the number as well as the relative positioning of the snap clamp means 24 and 26 and the support members 40 and 42 could obviously be varied without departing from the essence of the invention. With regard specifically to the container 60, the end walls 20 and 22 thereof may be provided, if so desired, with suitably located inwardly extending depending flange members operable for providing additional rigidity to the ends of the side walls 62 and 64 when the end walls 20 and 22 are brought into juxtaposed relation therewith in the closed position thereof, without departing from the essence of the invention. Although the container 10 has been described hereinabove as being of metal construction and the side walls 66 and 68 and the end walls 20 and 22 of the container 60 have likewise been described as being of metal construction it is to be understood that the container 60 may be formed of some type of substantially non-resilient material such as wood, etc. without departing from the essence of the invention.

Thus, it can be seen that the present invention provides a novel and improved container of the type operable for use in housing another container therewithin. Moreover, the container of the present invention is designed to be collapsible. Furthermore, in accord with the present invention a container has been provided having at least one pair of side walls which are capable of being collapsed and a pair of end walls which are movable between an open and a closed position relative to the side walls of the container. A container in accord with the present invention has been provided which is operable for purposes of dispensing therefrom material contained therewithin. In addition, in accord with the present invention a container has been provided with which funnel means are capable of being employed for purposes of filling another container housed within the container after the other container has been placed therein. Finally, a container has been provided in accordance with the present invention which is relatively inexpensive to manufacture, is easy to employ, yet is sufficiently durable so as to be capable of withstanding the rigors of normal wear and tear thereby to provide a relative long operating life.

I claim:

1. A collapsible container particularly adapted to be employed when in an uncollapsed condition for purposes of supporting therewithin a liner having contents located therein comprising:

a. housing means having an uncollapsed condition and a collapsed condition including a first pair of uncollapsible side walls and a second pair of collapsible side walls;

b. hinge means connecting each of said first pair of side walls and each of said second pair of side walls together for movement relative to each other between a first position corresponding to the uncollapsed condition of said housing means wherein said second pair of side walls are uncollapsed relative to said first pair of side walls and a second position corresponding to the collapsed condition of said housing means wherein said second pair of side walls are collapsed relative to said first pair of side walls;

c. a pair of uncollapsible end walls pivotally mounted at the opposite ends of one of said first pair of side walls for movement between a closed position relative to the other of said first pair of side walls corresponding to the uncollapsed condition of said housing means and an open position relative to the other of said first pair of side walls corresponding to the collapsed condition of said housing means;

d. cooperative securing means mounted on the free end of each of said pair of end walls and on the opposite ends of said other of said first pair of side walls operable for securing said pair of end walls in the closed position thereof;

e. one of said uncollapsible walls of the container having an opening formed therethrough, said opening being surrounded by an upstanding flange portion, said upstanding flange portion being internally threaded;

f. a liner having an opening provided therein through which the contents of said liner are capable of flowing, said liner being positioned within said housing means with said opening in said liner being aligned with said opening in said one of said uncollapsible walls; and g. means mounted in said opening in said one of said uncollapsible walls operable to selectively control the flow of contents between the interior of said liner and the exterior of said housing means through said opening in said liner and said opening in said one of said uncollapsible walls by controlling the flow of the contents through said means, said means mounted in said opening in said one of said uncollapsible walls comprising a spigot including a tubular member having a through passage formed therein and a spigot portion having a handle formed integrally therewith, said spigot portion being mounted on said tubular member at one end thereof for rotation relative thereto between a dispensing position and a nondispensing position, said tubular member including a multiplicity of threads formed externally at the other end thereof threadedly engageable with said internal threads formed in said upstanding flange portion for mounting said spigot in said opening in said one of said uncollapsible walls, said through passage in said tubular member having an outwardly projecting circumferential rib formed therein inwardly of said other end of said through passage and a bushing formed of resilient material having one end thereof corresponding in diameter to the diameter of said through passage in said tubular member and the other end thereof having a diameter greater than the diameter of said through passage in said tubular member, said one end of said bushing being inserted into said through passage at said other end of said tubular member to capture said liner between said circumferential rib and said one end of said bushing so as to attach said liner to said spigot, said bushing having an opening formed therethrough to permit the contents of said liner to flow therethrough to said through passage in said spigot, said other end of said bushing being operable to close off said opening in said one of said uncollapsible walls when said spigot is removed from said opening in said one of said uncollapsible walls.

2. The container as set forth in claim 1 further comprising support means mounted on said first pair of uncollapsible side walls at the opposite ends thereof operable to receive said pair of uncollapsible end walls in engagement therewith when said pair of uncollapsible end walls are in the closed position.

3. The container as set forth in claim 1 wherein said cooperative securing means comprises a first pair of snap clamp means operable for securing one of said pair of uncollapsible end walls in a closed position and a second pair of snap clamp means operable for securing the other of said pair of uncollapsible end walls in a closed position.

4. The container as set forth in claim 1 wherein each of said second pair of collapsible side walls comprises a pair of panels and means connected to each of said pair of panels operable for moving said pair of panels between a first position wherein said second pair of collapsible side walls are in an uncollapsed condition and a second position wherein said second pair of collapsible side walls are in a collapsed condition.

5. The container as set forth in claim 4 wherein said means connected to each of said pair of panels comprises a multiplicity of hinges each having one leaf thereof secured to one of said pair of panels and the other leaf thereof secured to the other of said pair of panels.

6. The container as set forth in claim 4 wherein said means connected to each of said pair of panels comprises a length of tape having a portion thereof secured to each of said pair of panels.

7. The container as set forth in Claim 1 wherein each of said second pair of collapsible side walls comprises an integral member formed of a nonmetallic resilient material having sufficient inherent flexibility to enable said member to be collapsed upon itself.

8. A collapsible container particularly adapted to be employed when in an uncollapsed condition for purposes of supporting therewithin a liner having contents located therein comprising:

a. housing means having an uncollapsed condition and a collapsed condition including a first pair of uncollapsible side walls and a second pair of collapsible side walls;

b. hinge means connecting each of said first pair of side walls and each of said second pair of side walls together for movement relative to each other between a first position corresponding to the uncollapsed condition of said housing means wherein said second pair of side walls are uncollapsed relative to said first pair of side walls and a second position corresponding to the collapsed condition of said housing means wherein said second pair of side walls are collapsed relative to said first pair of side walls;

c. a pair of uncollapsible end walls pivotally mounted at the opposite ends of one of said first pair of side walls for movement between a closed position relative to the other of said first pair of side walls corresponding to the uncollapsed condition of said housing means and an open position relative to the other of said first pair of side walls corresponding to the collapsed condition of said housing means;

d. cooperative securing means mounted on the free end of each of said pair of end walls and on the opposite ends of said other of said first pair of side walls operable for securing said pair of end walls in the closed position thereof;

e. one of said uncollapsible walls of the container having an opening formed therethrough, said opening being surrounded by an upstanding flange portion, said upstanding flange portion being internally threaded;

f. another one of said uncollapsible walls having formed therethrough a second opening, said second opening being surrounded by an upstanding flange portion;

g. a liner having an opening provided therein through which the contents of said liner are capable of flowing, said liner being positioned within said housing means with said opening in said liner being aligned with said opening in said one of said uncollapsible walls, said liner having a second opening provided therein through which contents are capable of being inserted into said liner, said liner being positioned within said housing means within said second opening in said liner being aligned with said second opening in said another one of said uncollapsible walls;

h. means mounted in said opening in said one of said uncollapsible walls, said means mounted in said opening in said one of said uncollapsible walls comprising a spigot detachably mounted in said opening in said one of said uncollapsible walls so as to be operable to selectively control the flow of the contents of said liner from said liner externally of said housing means; and i. funnel means provided cooperatively associated in juxtaposed relation to said second opening in said another one of said uncollapsible walls for purposes of enabling contents to flow therethrough into said liner, said funnel means comprising a spiral spring of varying diameter, said spiral spring increasing progressively in diameter from one end thereof to the other end thereof, said spiral spring having an expanded condition employed when said spiral spring is being utilized for purposes of enabling contents to flow therethrough into said liner and a collapsed condition employed for storing said spiral spring within the container when the container is in the collapsed condition thereof, said spiral spring being mountable on said housing means with the smaller diameter end thereof mounted about said second opening in said another one of said uncollapsible walls said liner having a portion thereof adjacent said second opening therein being drawn through the center of said spiral spring from the smaller diameter end thereof to the larger diameter end thereof and wrapped around said spiral spring.

* * * * *